US005477441A

United States Patent [19]

Budnovitch et al.

[11] Patent Number: 5,477,441

[45] **Date of Patent: * Dec. 19, 1995**

[54] LIGHT FIXTURE LENS MOUNTING SYSTEM

[75] Inventors: William F. Budnovitch, Parkville; Mahendra K. Patel, Weatherby Lake, both of Mo.; Lawrence Luciano, Morristown, N.J.

[73] Assignee: William F. Budnovitch Revocable Trust, Parkville, Mo.

[ * ] Notice: The portion of the term of this patent subsequent to Oct. 5, 2010, has been disclaimed.

[21] Appl. No.: 101,857

[22] Filed: Aug. 4, 1993

Related U.S. Application Data

[63] Continuation-in-part of Ser. No. 745,835, Aug. 16, 1991, Pat. No. 5,251,118.

[51] Int. Cl.[6] ..... F21P 1/00

[52] U.S. Cl. ..... 362/362; 362/267; 362/455

[58] Field of Search ..... 362/267, 955, 362/956, 362

[56] References Cited

U.S. PATENT DOCUMENTS

| | | | |
|---|---|---|---|
| 145,200 | 12/1873 | Hyatt | 362/456 |
| D. 191,905 | 12/1961 | Haywood . | |
| D. 196,670 | 10/1963 | Kinnear et al. . | |
| D. 263,761 | 4/1982 | Glassman . | |
| 1,499,083 | 6/1924 | Stephens . | |
| 1,994,669 | 3/1935 | Schaffner . | |
| 2,616,029 | 10/1952 | Osowski . | |
| 2,871,342 | 1/1959 | Mappes | 362/267 |
| 2,962,583 | 11/1960 | Balser | 362/267 |
| 3,093,167 | 7/1963 | Jensen et al. | 362/267 |
| 3,101,908 | 8/1963 | Mooae . | |
| 3,104,832 | 9/1963 | Ford . | |
| 3,328,573 | 6/1967 | Nava et al. | 362/267 |
| 3,593,014 | 7/1971 | Vesely . | |
| 3,902,057 | 8/1975 | LaViolette | 362/267 |
| 4,115,845 | 9/1978 | Blahut . | |
| 4,195,331 | 3/1980 | Jones . | |
| 4,217,629 | 8/1980 | Russell . | |
| 4,225,909 | 9/1980 | Scholz et al. . | |
| 4,232,362 | 11/1980 | Williams et al. . | |
| 4,317,163 | 2/1982 | Bout . | |
| 4,317,164 | 2/1982 | Karaktin . | |
| 4,398,239 | 8/1983 | de Vos et al. . | |
| 4,438,484 | 3/1984 | Winden . | |
| 4,489,367 | 12/1984 | Herron et al. . | |
| 4,490,778 | 12/1984 | Collins et al. | 362/267 |
| 4,536,831 | 8/1985 | English et al. | 362/267 |

(List continued on next page.)

FOREIGN PATENT DOCUMENTS

| | | |
|---|---|---|
| 277438 | 9/1927 | United Kingdom . |

*Primary Examiner*—Stephen F. Husar
*Attorney, Agent, or Firm*—Litman, McMahon and Brown

[57] ABSTRACT

A light fixture lens mounting system includes a lighting fixture body having an opening, a lens, and a lens mounting ring having structure for supporting the lens over the opening, the body opening and the lens mounting ring being fitted with a series of corresponding lugs for interlocking engagement. Preferably, the body lugs project outwardly from a rim to form an outwardly open groove and the ring lugs project inwardly from the ring to form an inwardly open groove to permit interlocking engagement of the body lugs in the ring groove and the ring lugs in the body groove. In particularly preferred forms, the body lugs include structure for supporting a gasket adjacent the lens to provide a weathertight seal. In other preferred forms, the body lugs extend inwardly to form an inwardly open groove, and the rings project outwardly from the ring to form an outwardly open groove to permit interlocking engagement of the body lugs in the ring groove and the ring lugs in the body groove. Still other particularly preferred forms provide a three-part weatherproof system for sealing the interior of the fixture, in which the body and ring are configured to permit interlocking of the lugs and ring adjacent the fixture interior. A gasket is supported outwardly from the locking structure, and the fixture body includes structure overhanging the ring.

6 Claims, 2 Drawing Sheets

U.S. PATENT DOCUMENTS 4,590,542 5/1986 Schauwecker et al. ..... 362/267
4,635,168 1/1987 Crowley .
4,707,766 11/1987 Bertozzi et al. .
4,760,508 7/1988 Russello et al. .
4,782,435 11/1988 Manzoni .
4,794,500 12/1988 Bradley ..... 362/267
4,924,366 5/1990 Shemitz et al. .
5,034,869 7/1991 Choi .
5,176,441 1/1993 Horvath et al. ..... 362/455

Fig. 1.
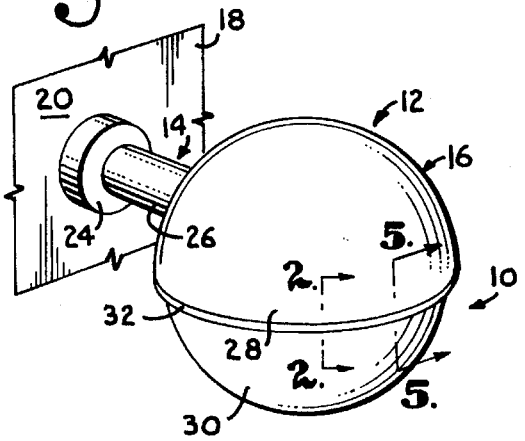
Fig. 2.
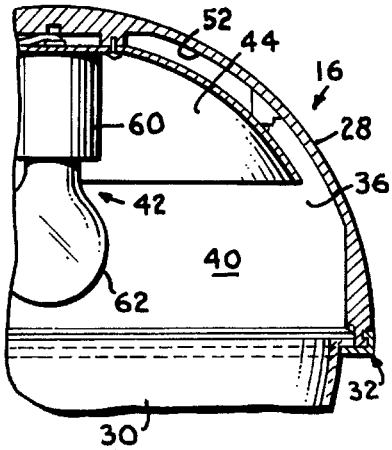
Fig. 3.
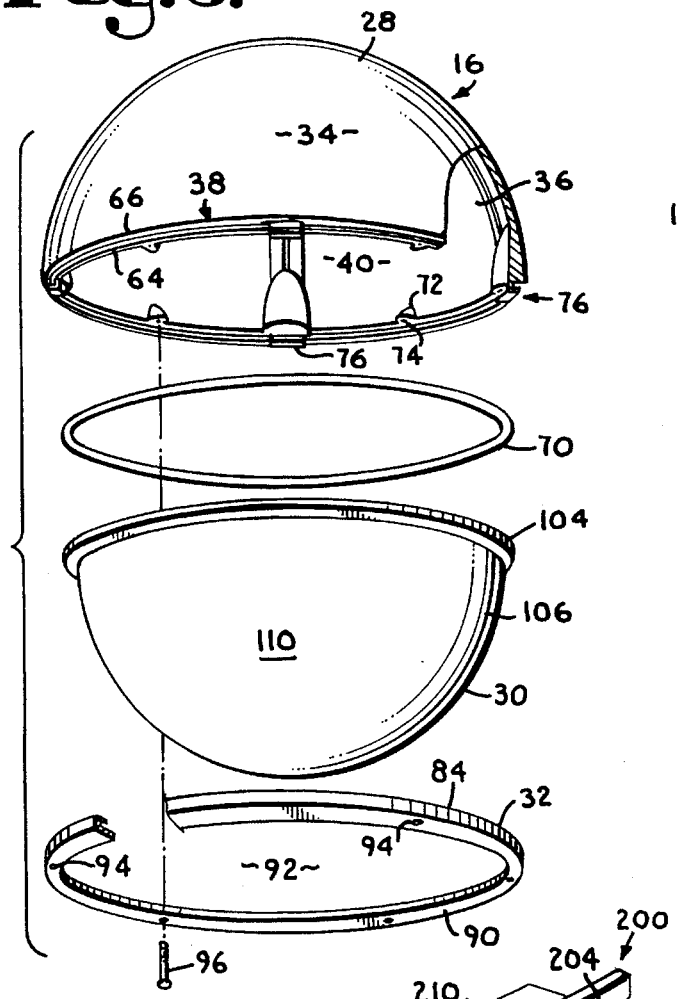
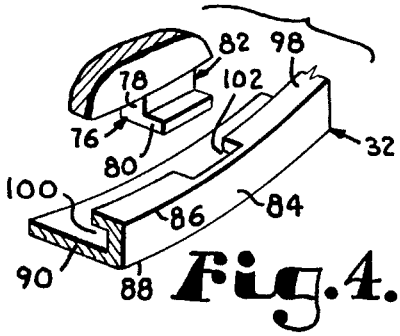
Fig. 4.
Fig. 5.
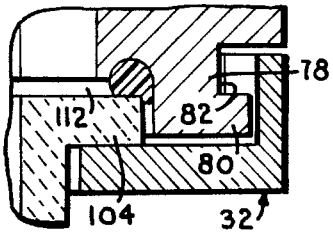
Fig. 6.
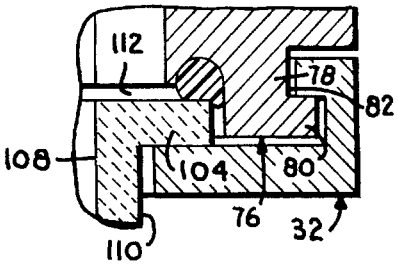
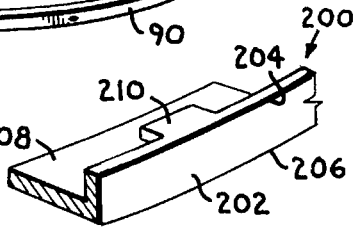
Fig. 7.

LIGHT FIXTURE LENS MOUNTING SYSTEM

CROSS REFERENCE TO RELATED APPLICATION

This application is a continuation-in-part of U.S. patent application Ser. No. 07/745,835 filed Aug. 16, 1991, entitled MODULAR LIGHTING SYSTEM AND METHOD, now U.S. Pat. No. 5,251,118. The subject matter of the parent application is expressly incorporated herein by reference.

BACKGROUND OF THE INVENTION

1. Field of the Invention

The present invention is broadly concerned with a system for securely yet removably mounting a lens assembly on a lighting fixture. More particularly, it is concerned with a system including a fixture body, a lens, and a lens mounting ring, the body and ring being constructed with corresponding interlocking lugs.

2. Description of the Related Art

An assortment of mounting systems has heretofore been devised for applications involving a wide variety of objects, including lighting fixtures. Different types of mounting systems are available for removable and permanent mounting.

Lighting fixtures commonly include at least one lens interposed between a light source and the exterior of the fixture. The light source is mounted on the interior of the fixture, and the light filters outwardly, through the lens. The lens may be fixedly attached by means of screws, pins, clips or the like. However, it is desirable to mount the lens so that it can be removed easily for periodic cleaning and relamping, and, when reassembled, will seal the interior of the fixture against weather.

Prior art fixture mounting systems for lenses typically involve screws, pins, or clips which must be serially installed, or threading which is difficult to align. In most cases, the lens must be supported while it is mounted on the fixture. This problem is most notable in the case of pendant fixtures. Where the luminaire is small, it may be possible to support the lens using one hand and, using the other hand, insert a first screw, tighten it, insert a second screw in an opposed position, tighten it, and release the fixture to be supported by the two fasteners while the remainder of the fasteners are installed. In a larger, heavier fixture, it may be necessary to support the lens until several pairs of fasteners are installed. If the lens is extremely heavy it may be necessary for one person to support the lens while another installs the fasteners. Conversely, removal of a lens supported by individual fasteners presents a similar support problem. Where a large, heavy pendant fixture is mounted high above the floor so that access must be by ladder, lens cleaning and relamping can be extremely burdensome.

SUMMARY OF THE INVENTION

The present invention overcomes the problems previously outlined and provides a greatly improved lens mounting system for lighting fixtures. Broadly speaking, the system includes a lighting fixture body having an opening, a lens, and a lens mounting ring having structure for supporting the lens over the opening, the body opening and lens mounting ring being fitted with a series of corresponding lugs for interlocking engagement. Preferably, the body lugs project outwardly from a rim to form an outwardly open groove and the ring lugs project inwardly from the ring to form an inwardly open groove to permit interlocking engagement of the body lugs in the ring groove and the ring lugs in the body groove. In particularly preferred forms, the body lugs include structure for supporting a gasket adjacent the lens to provide a weathertight seal.

In still other preferred forms, the body lugs extend inwardly to form an inwardly open groove, and the ring lugs project outwardly from the ting to form an outwardly open groove to permit interlocking engagement of the body lugs in the ring groove and the ring lugs in the body groove.

Particularly preferred forms provide a three-part weatherproof system for sealing the interior of the fixture. In such forms the body and ring are configured to permit interlocking of the lugs and ring adjacent the interior of the fixture, with a gasket supported outwardly from the locking structure, and the fixture body including structure overhanging the ring.

OBJECTS AND ADVANTAGES OF THE INVENTION

The principal objects and advantages of the present invention include: providing a light fixture lens mounting system which can be easily installed or removed for convenient cleaning or relamping of the fixture; providing such a system which permits quick coupling of a lens mounting ring onto a fixture in a single movement, without the need for separate installation of multiple individual fasteners; providing such a system which does not require the use of screws, pins, clips, or the like; providing such a system which is particularly well-adapted for use with pendant and overhead light fixtures; providing such a system which includes a weatherproof sealing member; providing such a system which includes a three-part weatherproof system for sealing the interior of the fixture; providing such a system which is constructed to provide a visually appealing external reveal.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a top, from left side perspective view of a wall-mounted extension arm, downlight lighting fixture embodying the present invention;

FIG. 2 is a fragmentary sectional view taken along line 2—2 in FIG. 1 showing an incandescent lamp;

FIG. 3 is an exploded view of the invention depicted in FIG. 1;

FIG. 4 is an enlarged, fragmentary perspective view of one embodiment of the lens ring of the present invention having a substantially continuous flange;

FIG. 5 is a sectional view taken along line 5—5 in FIG. 1, showing a tab engaging the slot;

FIG. 6 is a sectional view similar to that depicted in FIG. 5 but with the ring rotated to engage the body lug and lock the ring in place;

FIG. 7 is an enlarged, fragmentary perspective view of an alternate embodiment of the lens ring of the present invention having small tabs in lieu of a continuous flange;

DETAILED DESCRIPTION OF THE INVENTION

Figure 8:
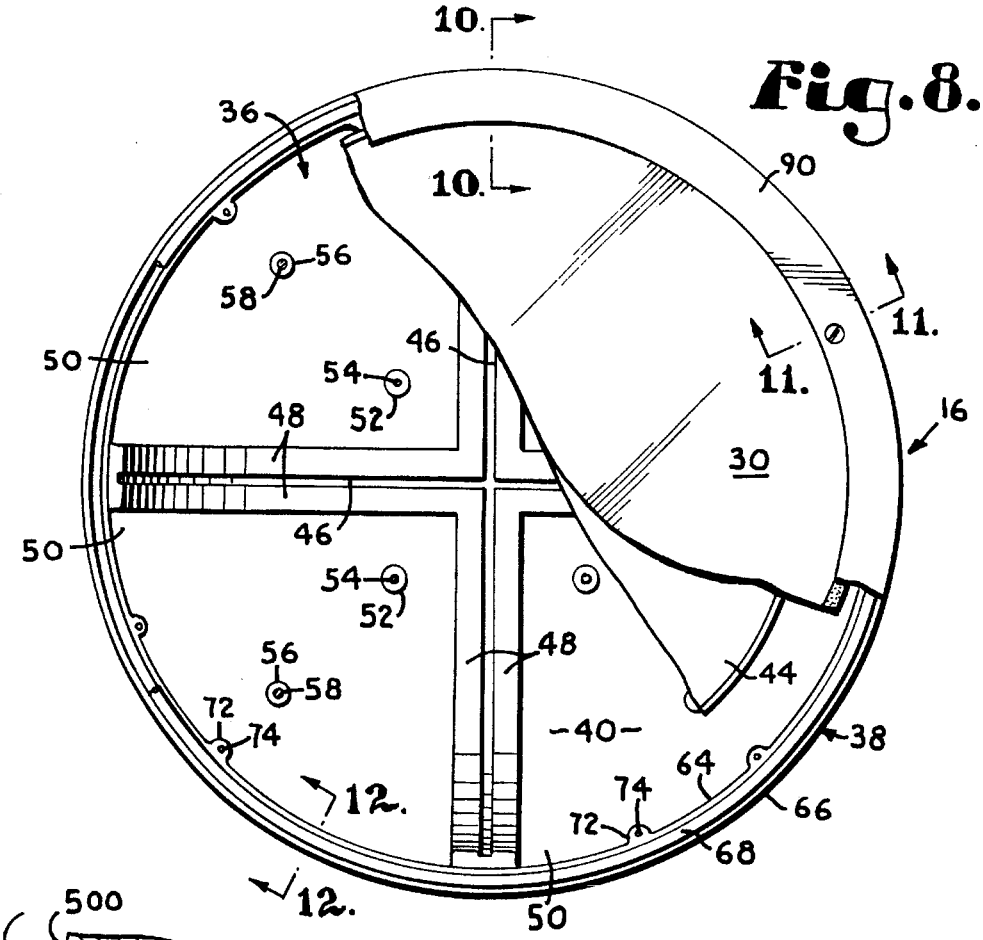
FIG. 8 is a bottom plan view of an embodiment having a flat lens, with portions broken away to illustrate the interior thereof.
Figure 9:
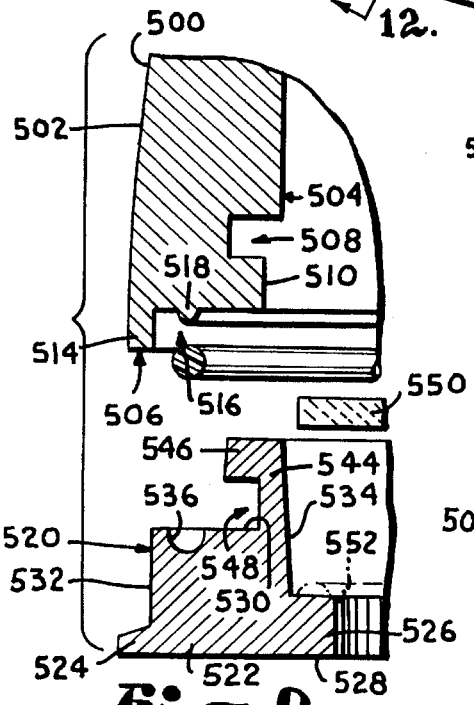
FIG. 9 is a fragmentary exploded cross-sectional view similar to that depicted in FIG. 12.
Figure 12:
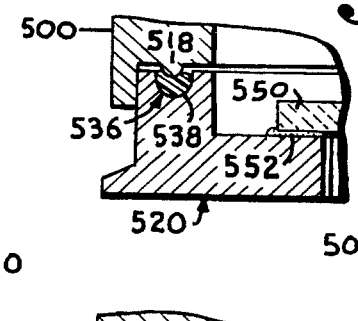
FIG. 12 is an enlarged, fragmentary cross-sectional view taken along line 12—12 of FIG. 8.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring now to the drawing, a lighting fixture lens mounting system 10 in accordance with the invention is shown employed in association with a fixture 12, including a mounting bracket assembly 14 and a luminaire assembly 16. Mounting bracket assembly 14 couples fixture 12 with the wall 18 of a structure. An electrical junction box (not shown) is installed in the wall structure so as to present an opening substantially flush with an exterior surface 20. The junction box may be coupled with other structural elements of the structure, such as wall studs or ceiling joists, to impart strength sufficient to support fixture 12. The junction box houses electrical wires remotely coupled with a source of electricity, such as the electrical service of a building or other structure. Mounting bracket assembly 14, includes a mounting plate (not shown) coupled with the junction box and covered by a mounting cover 24 and a mounting arm 26. Mounting arm 26 is preferably constructed of a metal such as extruded aluminum, although synthetic resin, wood, or stone may be employed, and the arm may be of any suitable length.

As best shown in FIGS. 2 and 3, luminaire assembly 16 includes a body 28, and a lens 30, intercoupled by a lens mourning ring 32. Luminaire body 28 presents a generally hemispherical outer body surface 34 and an interior 36 conjoined by an annular rim 38.

Body interior 36 presents an interior surface 40, an illumination source 42, and a reflector 44. As best shown in FIG. 8, interior 36 is quadrisected by a pair of channels 46 formed in the center of thickened strips 48 which extend between pairs of opposed points on rim 38. Channels 46 are open to body interior 36 and intersect to form four substantially equal interior quadrants 50. Each quadrant 50 includes an inner screw boss 52 projecting into interior 36 and having a threaded receiver 54, and an intermediate screw boss 56 with a threaded receiver 58. In preferred forms body 28 is constructed of a cast metal such as aluminum or brass although other suitable materials, including synthetic resins such as bakelite, may be employed.

Generally arcuate reflector 44 is constructed of a light reflective, fireproof material such as polished aluminum and is correspondingly apertured to permit insertion of screws therethrough into receivers 54,58 for mounting of the reflector in spaced relationship to interior surface 40. In other embodiments, reflector 44 can be of substantially flat construction to conceal internal components from view. An additional aperture, generally located on center, is provided to permit mounting of illumination source 42 and passage of associated electrical wires outwardly through mounting arm 26. As best shown in FIG. 2, illumination source 42 includes an electrical socket 60 mounted on reflector 44 to threadably receive a lamp 62. Lamp 62 may be incandescent, fluorescent (including compact fluorescent), metal halide, high pressure sodium, or any other suitable type. Where appropriate, an ignitor, ballast, capacitor, and heat sink may be employed in conjunction with lamp 62.

As best shown in FIGS. 3–6 and 8, body rim 38 includes inner and outer perimeter margins 64, 66 with an annular groove 68 formed in the ring therebetween to receive a flexible O-ring gasket 70. A plurality of outer screw bosses 72 having threaded receivers 74 extend inwardly at spaced intervals from inner perimeter rim margin 64.

A plurality of lens mounting lugs 76 extend generally downwardly and outwardly at spaced intervals from rim 38. Although in a small fixture a single lug may be employed, a plurality is preferred. The lugs are preferably positioned at spaced, generally equidistant intervals, for example, four lugs positioned at 90° radial intervals. Each lug 76 includes a generally downwardly depending proximal leg 78 and a generally outwardly extending distal leg 80, forming an outwardly facing lug channel 82 therebetween.

Lens mounting ring 32 is generally configured to fit adjacent and flush with fixture outer body surface 34 upon installation in locking relationship with rim 38. Ring 32 includes an annular, upstanding perimeter flange 84, presenting an uppermost inner margin 86, which is adjacent rim 38 when the ring is installed, and a lowermost outer margin 88.

A generally flat, annular face flange 90 extends inwardly from the lowermost outer margin 88 to form a generally circular lens opening 92. Face flange 90 includes apertures 94 which align with threaded receivers 74 to permit insertion of screws 96 therethrough upon installation and locking of mounting ring 32 onto fixture 12.

A generally flat annular locking flange 98 extends inwardly from the uppermost inner margin 86. In this manner locking flange 98, perimeter flange 84 and face flange 90 cooperatively form a channel 100 for receiving lens mounting lugs 76. Ring locking flange 98 is substantially continuous, with slots 102 at spaced intervals for receiving body lugs 76. Lens mounting ring 32 may be formed of metal such as aluminum, chrome, brass, copper, or of synthetic resin or other material having sufficient rigidity and strength to support lens 30.

Lens 30 includes an annular perimeter flange 104 extending outwardly from a body portion 106 of generally hemispherical configuration as shown in FIGS. 1–3, and inner and outer surfaces 108, 110. In other preferred embodiments as depicted in FIG. 8, the lens body is flat. The lens may be constructed of any transparent or translucent material such as glass or synthetic resinous material such as polycarbonate.

Upon installation of lens 30 between ring 32 and rim 38 as shown in FIGS. 5 and 6, the lens perimeter flange 104 is captured between lens ring face flange 90 and body rim 38. A gap 112 which occurs between the lens flange inner surface 108 and body rim 38 is sealed by compressed gasket 70.

In the light fixture lens mounting system 10 of the present invention, a user installs a lens 30 in mounting ring 32 so that face flange 90 supports lens perimeter flange 104. The user fits an O-ring gasket 70 into gasket groove 68 on fixture body 28 and moves lens mounting ring 32 into position adjacent body rim 38 so that lens mounting lugs 76 are aligned with ring slots 102 (FIGS. 4,5).

In a single movement, the user then urges lens mounting lugs 76 into ring slots 102 and rotates ring 32 to simultaneously urge ring flange 98 into all lug channels 82 and all body lugs 76 into channel 100 in cooperative locking relationship (FIGS. 5,6). In this manner, the mounting ring 32 supports the lens 30 and locks it onto the fixture body 28 at a plurality of spaced points. This causes compression of O-ring gasket 70 between lens perimeter flange 104 and body rim 38 to form a weathertight seal.

Optional screws 96 may then be inserted through lens mounting ring apertures 94 and into aligned receivers 74 to secure the ring to the body 28. The process is reversed for removal of the lens 30 as, for example, to accomplish relamping.

Second Preferred Embodiment

A second preferred embodiment of the lens mounting system 10 includes a fixture substantially similar to that previously described with certain modifications to the rim and lens mounting ring. A modified lens mounting ring 200 is depicted in FIG. 7 to include an annular, upstanding perimeter flange 202, presenting an uppermost inner margin 204, which is adjacent the fixture rim when the ring is installed, and a lowermost outer margin 206. A generally flat, annular face flange 208 extends inwardly from the lowermost outer margin 206. A plurality of spaced, generally tab-shaped locking lugs 210 extend inwardly from the uppermost inner margin 204.

A substantially continuous perimeter flange extends from the body rim (not shown) and includes slots at spaced intervals for receiving ring locking lugs 210.

In use, the second preferred embodiment of the light fixture lens mounting system 10 is substantially similar to that previously described. Lens ring lugs 210 (FIG. 7) are aligned with corresponding body rim slots, and the ring is rotated to urge ring lugs into rim channel in locking relationship.

Third and Fourth Preferred Embodiments

A third preferred embodiment of the lens mounting system 10 includes a fixture substantially similar to that previously described and depicted in FIGS. 1–6 except that lens mounting lug distal leg 80 extends inwardly, toward body interior 36. Rim 38, and proximal and distal legs 78 and 80 cooperatively form channel 82, which faces inwardly as well. In corresponding fashion, ring locking flange 98 extends outwardly and together with perimeter flange 84 forms outwardly facing channel 100.

In a fourth preferred embodiment tab-shaped ring locking lugs similar to those depicted in FIG. 7 face outwardly and a substantially continuous perimeter flange extends inwardly from the body rim and includes slots at spaced intervals for receiving the ring locking lugs.

In use, the third and fourth preferred embodiment of the light fixture lens mounting system 10 is substantially similar to those previously described except that the orientations of the lugs and channels are reversed.

Fifth Preferred Embodiment

A fifth preferred embodiment of the lens mounting system 10 includes a fixture substantially similar to that previously described with certain modifications to the rim and lens mounting ring depicted in FIGS. 9–12. A fixture body 500 includes a generally hemispherical outer body surface 502, an interior 504, and an annular rim 506.

Interior surface 504 includes an annular channel 508 offset from rim 506 to form a substantially continuous annular flange 510, having slots 512 at spaced intervals. Rim 506 is medially stepped to form an outer lip portion 514, and an inner channel portion 516 including a depending ridge 518.

Figure 11:
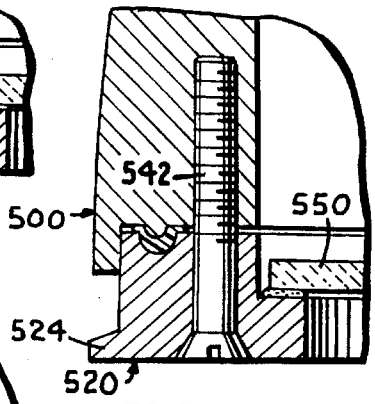
FIG. 11 is an enlarged, fragmentary cross-sectional view taken generally along line 11—11 of FIG. 8.
Figure 10:
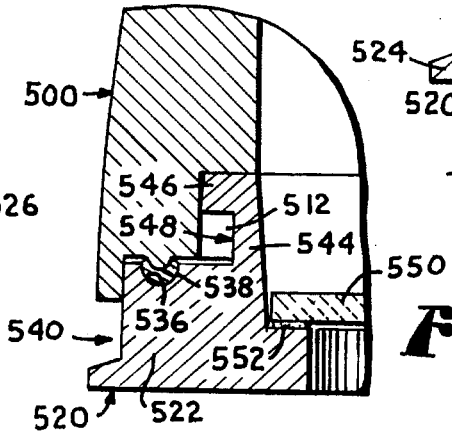
FIG. 10 is an enlarged, fragmentary cross-sectional view taken generally along line 10—10 of FIG. 8.

A lens mounting ring 520 includes an annular base portion 522 presenting a lowermost outwardly extending foot 524, a lowermost inwardly extending lens-supporting flange 526, a lower face 528, an upper face 530 which is adjacent fixture rim 506 when installed, and outer and inner faces 532, 534. Upper face 530 includes an annular groove 536 to receive a gasket 538. Fixture body outer surface 502 and lens ring outer face 530 cooperatively form a reveal 540 upon installation and locking of lens mounting ting 520 onto fixture body 500. Body 500 and lens ring lower face 528 are apertured as shown in FIG. 11 to permit insertion of threaded screws 542 therethrough.

The inner perimeter of upper face 530 is extended to form an upstanding annular flange 544. Generally flat, tab shaped lugs 546 extend transversely outwardly at spaced intervals from the uppermost portion of flange 544. Lugs 546, flange 544, and upper face 530 thus cooperatively form a channel 548 to accept body flange 510. As previously discussed with respect to the first and second described embodiments of the present invention, lugs at spaced intervals may be substituted for body flange 510 and a corresponding ring flange may be substituted for spaced lugs 546.

A lens 550 is supported on flange 526 with a glue bead 552 therebetween to secure the lens.

In use, the fifth preferred embodiment of the light fixture lens mounting system 10 is substantially similar to those. previously described. A user applies a bead of an adhesive substance such as caulk, putty or glue 552 to mounting ring lens flange 526 and installs a lens 550 atop the glue. The user fits gasket 538 into groove 536 on lens ring 520 and moves the lens ring into position adjacent body 500 so that lens ring lugs 546 align with body slots 512 (FIG. 10) and base 522 aligns with rim channel 516.

In a single movement, the user then urges lens ring lugs 546 into body slots 512 and rotates ring 520 to simultaneously urge ring all lugs 546 into channel 508 and body flange 510 into ring channel 548 in cooperative locking relationship. In this manner lens ring 520 supports the lens 550 and is locked onto the fixture body 500 at a plurality of spaced points. Installation of ring 520 on rim 506 causes compression of gasket 538 between ring base 522 and body ridge 518 to form a weathertight seal. Lip 514 partially depends over ring outer face 532 to provide a further impediment to moisture and to form a visually appealing reveal 540. In this manner, the interlocking of lugs 546 and flange 5 10 and channels 508 and 548 respectively form a first, inner weatherproof barrier. Gasket 538 forms a second, intermediate barrier, and depending lip 514 forms a third, outermost impediment to the elements.

Optional screws 542 may then be inserted through lens mounting ring apertures into aligned receivers to secure the ring to the body 500. The process is reversed for removal of the lens 550.

It is to be understood that while certain forms of the present invention have been illustrated and described herein, it is not to be limited to the specific forms or arrangement of parts described and shown.

What is claimed and desired to be secured by Letters Patent is as follows:

1. A light fixture lens mounting system, comprising:

(a) a frusto-spherical body with a concave inner surface forming an interior and a convex outer surface, said body including a rim having a curvilinear configuration, said body encompassing one or more 90 degree sectors, said body including a thickened strip along each edge of one or more of said 90 degree sectors with each said strip at least partially extending from said rim to a top portion of said body;

(b) said body including a lens mounting lug coupled with said rim to form a generally outwardly open groove;

(c) a lens presenting inside and outside surfaces and having a generally circular perimeter margin;

(d) a lens mounting ring including an annular band having a generally cylindrical sidewall with proximal and distal edges;

(e) said lens mounting ring including structure projecting radially inwardly from said sidewall proximal edge for releasable mounting within said groove; and (f) lens retaining means projecting radially inwardly from said sidewall distal edge for engaging said lens margin in supporting relationship and retaining said lens in association with said rim when said rim structure is mounted within said body groove.

2. The apparatus as set forth in claim 1, wherein said body rim further includes a groove for receiving a gasket for engagement by said lens margin when said ring is installed on said fixture body in lens mounting relationship.

3. The apparatus as set forth in claim 1, wherein said body lug includes a proximal leg coupled with said rim and a distal leg extending outwardly from said proximal leg, said distal leg and said rim forming said outwardly open groove therebetween.

4. The apparatus as set forth in claim 1, wherein said lens ring structure and said lens retaining means cooperatively form an inwardly open lens ring channel for selectively receiving said body lug distal leg.

5. The apparatus as set forth in claim 1, wherein said body lugs form a flange and said ring structure forms lugs, said body flange including spaced slots for receiving said ring lugs.

6. The apparatus as set forth in claim 1, wherein said ring structure forms a flange and said body lugs form tabs, said ring flange including spaced slots for receiving said body lugs.

* * * * *